United States Patent [19]

Tullos et al.

[11] Patent Number: 4,509,605

[45] Date of Patent: Apr. 9, 1985

[54] WIRELINE PROTECTOR WITH IMPROVED CLAMPING MECHANISM

[75] Inventors: Homan C. Tullos, Lafayette, La.; Dewey W. Woods, Livingston, Tex.

[73] Assignee: Kelly Bushing Tools, Inc., Lafayette, La.

[21] Appl. No.: 511,984

[22] Filed: Jul. 8, 1983

Related U.S. Application Data

[63] Continuation-in-part of Ser. No. 246,095, Mar. 20, 1981, Pat. No. 4,431,067.

[51] Int. Cl.[3] ..... E27B 47/00

[52] U.S. Cl. ..... 175/57; 24/134 N; 24/132 WL

[58] Field of Search ..... 175/57; 24/132 WL, 134 L, 24/494, 134 N

[56] References Cited

U.S. PATENT DOCUMENTS

| | | | |
|---|---|---|---|
| 531,700 | 1/1895 | Rowland | 24/134 N |
| 588,446 | 8/1897 | Klein | 24/134 N |
| 744,730 | 11/1903 | Dusang | 24/134 W |
| 864,530 | 8/1907 | Garber | 24/134 N |
| 2,280,192 | 4/1942 | Hubbard | 24/134 N |
| 2,330,736 | 9/1943 | Paulson | 24/132 WL |
| 3,967,349 | 7/1976 | Christensen | 24/132 WL |

*Primary Examiner*—William F. Pate, III

*Attorney, Agent, or Firm*—LeBlanc, Nolan, Shur & Nies

[57] ABSTRACT

A wireline protector for protecting an electrical wireline used in a downhole drilling operation. During the operation of adding additional drill string members to the drill string, the electrical wireline is encased by and clamped within the wireline protector thereby guarding it against damage by any slippage of the slip members. The wireline protector includes an elongated section that is arranged to extend through the opening in the rotary table through which the drill string passes in such a manner so as not to interfere with the drill string and a support base connected substantially perpendicular to the elongated section. The elongated section has an elongated opening into which the portion of the wireline passing through the rotary table can be inserted so that it is substantially surrounded and guarded by the elongated section. After the wireline is inserted into this elongated section, a toggle lock clamping mechanism mounted on the support base acts to grip the wireline so as to retain it in place. The support base is arranged in engagement with the rotary table so as to maintain the wireline protector in place.

27 Claims, 10 Drawing Figures

WIRELINE PROTECTOR WITH IMPROVED CLAMPING MECHANISM

RELATED APPLICATION

The present application is a continuation-in-part of U.S. patent application Ser. No. 246,095 entitled WIRELINE PROTECTOR WITH CLAMPING MECHANISM and filed March 20, 1981 now U.S. Pat. No. 4,431,067. Such prior patent application is hereby incorporated by reference as though fully set forth herein.

BACKGROUND OF THE INVENTION

The present invention relates to equipment for use during a downhole drilling operation.

During a downhole drilling operation, in the area of the downhole drilling bit there is usually arranged an electrical sensing member. This electrical sensing member serves to detect the path of the drilling operation. An electrical wireline from a supply at the surface extends along the drilling string and is attached to the electrical sensing member. Typically, the wireline extends along the outside of the drilling string for a certain distance from the drill floor until it reaches a side entry subassembly at which point it enters the interior of the drill string and travels through the drill string until it reaches the sensing member. Such side entry subassemblies are manufactured by Sperry-Sun and are disclosed in U.S. Pat. No. 4,062,551.

The drill string assembly is attached at its upper end to a kelly which passes through a kelly bushing and the opening in the rotary table. As the drill bit advances into the earth, the kelly with the attached drill string moves downwardly with the bit. When the majority of the kelly has entered the hole being drilled, a new drill string member is attached. The drill string and the kelly with the kelly bushing are lifted out of the hole so as to bring the uppermost portion of the top drill string member up through the opening in the rotary table. A plurality of slips are then inserted between the rotary table and the top drill string member so as to secure the top drill string member and the attached drill string assembly to the rotary table. The kelly is then detached from the uppermost drill string member and an additional drill string member is inserted. Typically, one drill string member is inserted at a time. The kelly then is reattached and the drilling operation is continued.

When the top drill string member is secured to the rotary table by the slips, great care must be taken to avoid having any slippage of the slips which can result in damage to the electrical wireline. If the electrical wireline is either pinched or possibly even broken by the slips, the entire wireline must be removed from the drill hole. In order to remove the wireline, the drill string assembly must be removed from the ground until the point of location of the side entry subassembly. This removal takes considerable time away from the productive drilling operations. The wireline then is removed and a new wireline inserted. Such an operation results both in having to discard a significant quantity of electrical wire, which can typically be on the order of 10,000 feet, and a time consuming operation for having to replace the electrical wireline. Such damage, therefore, further increases the cost of the drilling operation.

In addition to preventing damage to the electrical wireline during the steps of adding drill string members, there is a need to prevent the wireline from sliding downward into the drill hole since tension is taken off the wireline during these steps. A clamping mechanism is thus needed and the above-referenced co-pending application shows several embodiments of such clamping mechanisms. It has been discovered that large clamping surfaces and greater consistently applied clamping force is of use when dealing with heavy wirelines. Such wirelines are used in deep holes and for some drilling situations where higher gauge wirelines are employed.

While various devices have been employed for protecting an electrical wireline during a drilling operation, these devices are neither capable of, nor were they developed for the purpose of, resolving the above-described problems. Typical of the devices that have been used in drilling operations are those shown by the following U.S. Pat. Nos. 2,829,190 to Comlossy and 3,048,358 to Raulins. The patents to Comlossy and Raulins both illustrate protective members that are attached to the drill string. The wireline is arranged within a protector member and extends along the outer length of the drill string to the area of the drill bit. These devices are primarily designed to prevent the electrical wire from becoming twisted or wrapped around the drill string member as it is rotated and also to protect the wireline from being damaged by the drill string members within the hole being drilled. With the utilization of the side entry subassembly, however, the electrical wireline passes through the center of the drill string members and hence the clamps disclosed by the patents to Comlossy and McCarthy are not needed.

When drilling under certain conditions, it is necessary to insulate the electrical wire from certain conditions that might occur during the drilling operation. For this purpose, U.S. Pat. No. 3,835,929 to Suman discloses encasing the electrical wireline within a special conduit that extends from the top of the hole being drilled down to the drilling bit along the outside of the drill string assembly. Once again the types of problems that this patent seeks to avoid are largely solved by the use of the side entry subassembly thereby rendering the use of the insulating tubing unnecessary.

Various other devices have been known in the art for shielding a cable as it passes between two points. Such devices are illustrated in the following U.S. Pat. Nos. 2,258,745 to Dewey et al; 2,408,253 to Diebold; and 3,716,733 to Keith et al. These devices, however, are not utilized in downhole drilling operations.

SUMMARY OF THE INVENTION

An electrical wireline protector is provided for use during the operation of adding additional drill string members to the drill string assembly. This wireline protector partially encases and retains the electrical wireline thereby preventing the slips from cutting or pinching such wireline.

The wireline protector includes an elongated section and a support base which is oriented so as to rest on the rotary table when in use. The support base is connected approximately perpendicular to the top portion of the elongated section. Preferably, the elongated sections and the support base should be respectively oriented so as to encompass an angle of slightly greater than 90°, ideally approximately 100°. During use of the wireline protector both the elongated section of the wireline protector and the drill string are arranged in the opening in the rotary table. The elongated section is arranged within such opening so as to avoid being in interference with the drill string. The elongated section has an elongated opening into which the portion of the electrical wireline that passes through the rotary table can be inserted so as to be substantially surrounded by the elongated section. The support base lies on top of the rotary table in engagement with the kelly and thereby maintains the wireline protector in place, i.e. prevents the wireline protector from sliding through the opening in the rotary table. In order to avoid any rotational movement of the wireline protector, the circumference of the elongated section should preferably be noncircular. The use of a noncircular circumference for the elongated section avoids any tendency of the wireline protector to roll within the opening in the rotary table.

To ensure that the electrical wireline is forcibly retained within the wireline protector, a toggle lock clamping mechanism is provided for grasping and securing the wireline at the top of the elongated section. The toggle lock clamping mechanism includes a clamping member which is relatively movable with respect to the fixed upper portion of the elongated member. The movable clamping member provides a first wireline clamping surface and the upper portion of the elongated member provides a second clamping surface. After insertion of the wireline, the clamping member is moved toward the second clamping surface to securely grasp the wireline thereby preventing the wireline from slipping out of the protector and from slipping through the protector. The clamping member is forced into engagement with the wireline by a toggle lock mechanism which is operated through a handle link. The movable clamping member is thus operated by a mechanism for locking it in its closed position, i.e. the position in which it firmly clamps the electrical wireline over a substantial surface area. In addition, a latch member can be provided at the top of the elongated section for blocking off the side opening of the top of the section so that the wireline cannot come out of the elongated section prior to clamping.

The elongated opening in the elongated section can take any one of several different forms. This elongated opening can have a cross-sectional shape of a parallelogram. Alternatively, the crosssectional shape of the elongated opening can be circular. While the access to the elongated opening can extend along a straight line, the path of the access can turn. If the access to the elongated opening does turn, preferably it turns by approximately 90°. Utilizing an embodiment where the access to the elongated opening does turn enables the wireline protector to be inserted into the opening and to then have at least some portion of the elongated section entirely wrapped around the electrical wireline thereby helping to ensure that it does not slip out of the elongated section.

An object of the present invention is, therefore, to avoid the potential damage to the electrical wireline that can occur during the downhole drilling operation as discussed above, Another object of the present invention is to provide an improved device for protecting the electrical wireline from damage during the operation of adding additional drill string members to a drill string assembly utilized in a downhole drilling operation.

A further object of the present invention is to provide a wireline protector that will prevent the slips from touching the electrical wireline and cutting or pinching such wireline.

Still another object of the present invention is to provide a wireline protector for securely clamping and protecting the electrical wireline when the protector is used.

These and other objects of this invention will become apparent from the following general description and the description of the drawings.

During the downhole drilling operation, when additional drill string members are to be added to the drill string assembly the electrical wireline protector of the present invention is utilized. The drill string assembly includes: the downhole drilling motor, an electrical sensing member, a drill string having at least one drill string member, a kelly attached to the upper end of the drill string, a rotary table having an opening through which the kelly and the drill string extend, and a supply of electrical wireline. The electrical wireline extends through the opening in the rotary table.

During the operation of adding additional drill string members, the kelly and the attached drill string are raised a sufficient distance so that the top portion of the uppermost drill string member extends through the opening in the rotary table. A plurality of slip members are then inserted between the rotary and the drill string so as to secure the drill string to the rotary table. The wireline protector then is inserted through the opening in the rotary table with the electrical wireline being arranged and clamped into place in the elongated opening in the elongated portion of the wireline protector. The kelly then is detached from the uppermost drill string member and a new drill string member inserted between the kelly and the top drill string member. The wireline protector is retained in its position extending through the opening in the rotary table during this entire operation. After the new drill string member has been secured in place and the kelly attached, the drilling operation is continued. Upon resuming the drilling operation, the wireline protector is unclamped from the wireline and removed.

DESCRIPTION OF THE PREFERRED EMBODIMENTS

Figure 1:
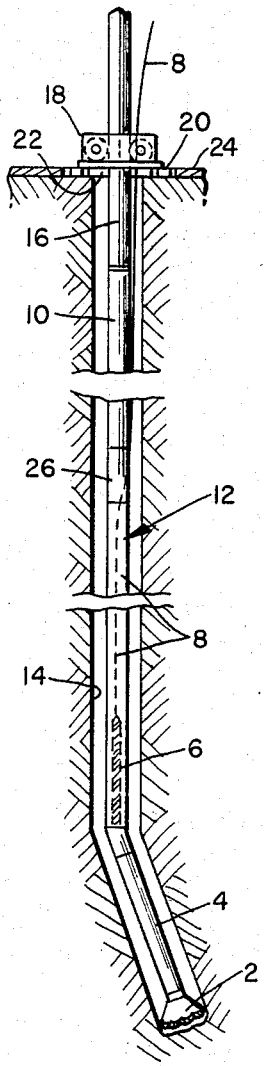
FIG. 1 is a schematic view of a downhole drilling system with which the present invention is utilized.

An exemplary downhole drilling system such as typically utilized in a directional drilling operation for correcting the alignment of the drilling path is illustrated in FIG. 1. At the bottom of the system is the drilling bit 2 that is driven by a downhole motor 4. Positioned immediately above the downhole motor is a sensing device 6 which senses the direction of movement of the drill bit so that signals can be fed back to the drill operators along electrical wireline 8 for correcting the path followed by the drill bit. The downhole motor is attached to the surface by a plurality of drill string members such as member 10 which form a drill string assembly 12. The drilling assembly is shown within a drilled well bore hole 14 in the earth.

The drill string assembly is driven by a kelly 16 which is held by a kelly bushing 18. Kelly bushing 18 is mounted on top of a rotary table 20. Rotary table 20 has an opening 22 through which the kelly passes so as to enter the drilled well bore hole 14. Rotary table 20 is arranged within rig floor 24. Since kelly 16 is secured against any relative rotational movement with respect to kelly bushing 18, by rotating the rotational table 20 and hence kelly bushing 18, kelly 16 is simultaneously rotated.

During the downhole drilling operation, the electrical wireline 8 is connected to sensing device 6 for supplying signals to and receiving signals back from the sensing device. Electrical wireline 8 is contained within the drill string 12 and passes through a side entry subassembly 26 onto the outside of the drill string. Electrical wireline 8 passes through well bore hole 14 and out the opening 22 in the rotary table. The wireline 8 is connected at its upper end to electrical analysis equipment (not shown).

Figure 2:
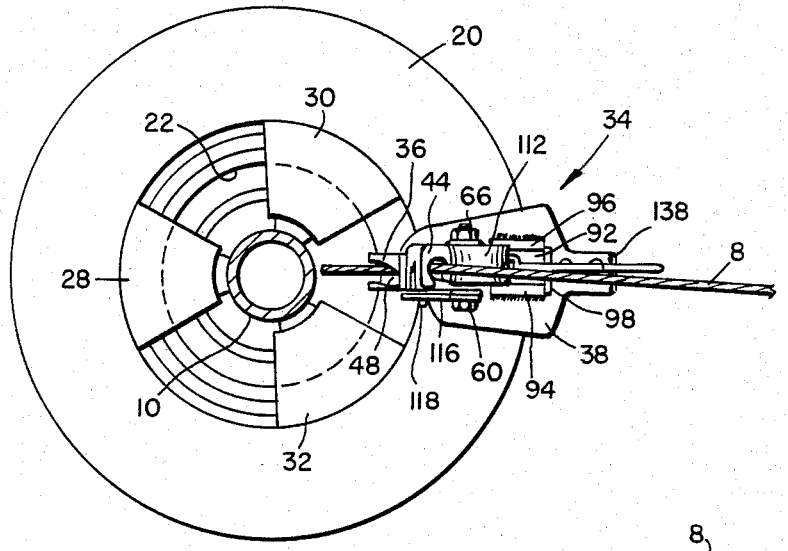
FIG. 2 is a top plan view of a rotary table with the wireline protector of the present invention shown inserted through the opening in the table.
Figure 3:
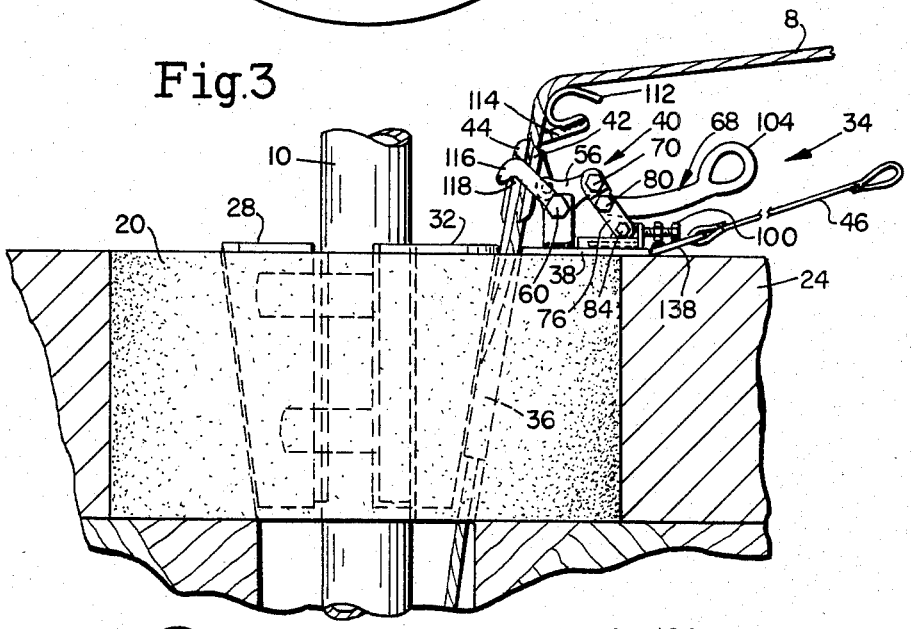
FIG. 3 is a cross-sectional side view of the rotary table with the inserted wireline protector of FIG. 2 shown clamping the wireline.

During the drilling operation, the entire drill string assembly 12, including the kelly 16, advances into the hole being drilled. When the top portion of the kelly reaches the kelly bushing 18, additional drill string members must be added. For this purpose, the kelly along with the kelly bushing are retracted so as to draw the drill string assembly up from the well bore hole being drilled. The kelly is retracted until the uppermost portion of the top drill string member passes through the rotary table. A plurality of slip members 28, 30 and 32, as shown in FIG. 2, are inserted in the opening in the rotary table so as to secure drill string member 10 to the rotary table 20. The opening 22 in the rotary table preferably has a conical shape with the smaller portion being at the bottom, as shown in FIG. 3, and the slip members similarly should be in the shape of truncated conical segments. With such a formation, the weight of the drill string assembly results in a force in a downward direction that creates a strong gripping force between the slip members and the drill string member 10 so that the drill string assembly 12 is securely fastened to inner walls of opening 22 in the rotary table 20.

Before the drill string assembly has been securely fastened to the rotary table, a wireline protector 34 is inserted and electrical wireline 8 is placed and clamped within an elongated portion 36 of wireline protector 34. By inserting electrical wireline 8 in elongated portion 36 of wireline protector 34, electrical wireline 8 is effectively encased so that it is protected against any slippage of the slip members.

In order to prevent the wireline protector from slipping through the opening in the rotary table, attached to elongated section 36 at its upper portion is a support base 38. Support base 38 extends approximately perpendicular to elongated section 36. Support base 38 rests on top of the rotary table 20 and elongated section 36 along the inner conically shaped wall of the rotary table as shown in FIG. 3. A toggle lock clamping mechanism 40 is mounted on support base 38 and is arranged to force a clamping member 42 against wireline 8 and into engagement with a clamp support 44. In order to make it easier to withdraw wireline protector 34 when the drilling operation is resumed, a rope or chain 46 is attached to the end of support base 38 of the wireline protector.

Once the wireline protector is inserted into opening 22 in the rotary table, in order to prevent any rotational movement of the wireline protector, it is desirable to make the outer circumference of the elongated section in the form of a parallelogram so that the sides are flat. Such a form for the elongated section inhibits any rotational movement of the wireline protector.

After the kelly 16 has been detached from the uppermost portion of the top drill string member 10 and the wireline protector inserted in place, the additional drill string members are added. After they are tightly secured between the kelly and the drill string assembly, the slips 28, 30 and 32 are removed and the drilling operation is resumed. Upon resuming the drilling operation, the wireline protector 34 can be removed from opening 22 in the rotary table.

The preferred embodiment of the wireline protector 34 which is shown in FIGS. 2–7 has an elongated section 36 and a support base 38 with the angle between such being approximately 100°. Elongated section 36 has a slot 48, the opening of which turns by 90° from side entry to front as it extends downward along elongated section 36. At the top end 50 of slot 48 the outer side of the elongated section 36 extends upwardly to form the fixed clamp support 44 for use with the clamping mechanism 40 for securely holding the wireline 8 once inserted into the slot 48.

Figure 4:
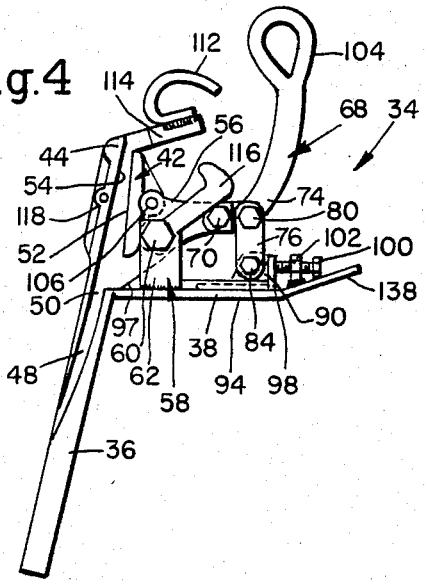
FIG. 4 is a side elevational view of the wireline protector of the present invention shown in the unclamped position.
Figure 7:
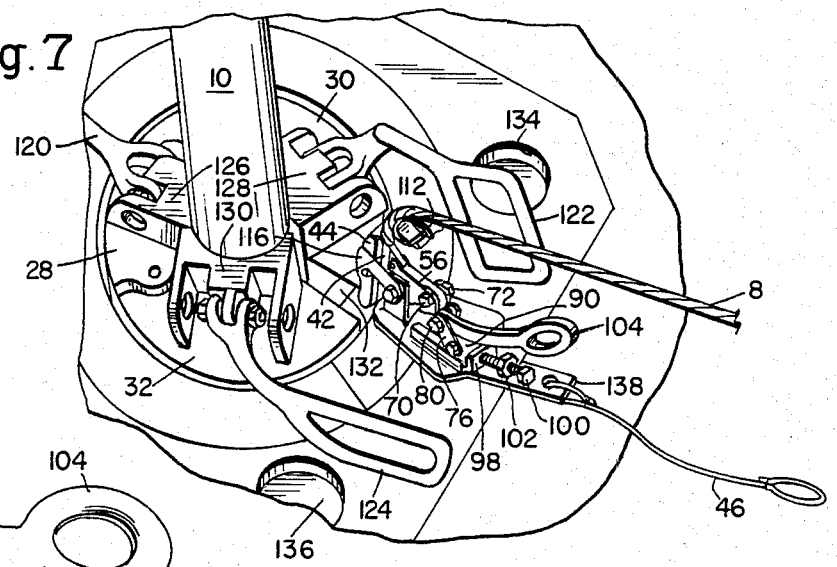
FIG. 7 is a perspective view of the wireline protector of the present invention arranged on the rotary table and shown in clamping position for use during the procedure of adding a drill string member.

The movable clamping member 42 of the clamping mechanism is moved between the clamped position shown in FIGS. 2, 3 and 7 and the unclamped position shown in FIG. 4 by the toggle lock mechanism 40. The wireline once inserted into slot 48 is also inserted into the space between clamping member 42 and clamp support 44 so that it is grasped by clamping surfaces 52 and 54 when the clamping member is placed in the closed position.

Figure 5:
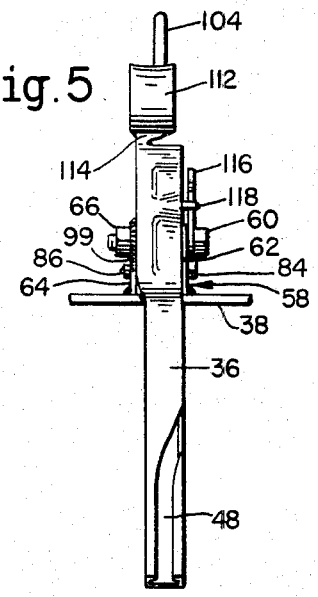
FIG. 5 is a front elevational view of the wireline protector of FIG. 4.
Figure 6:
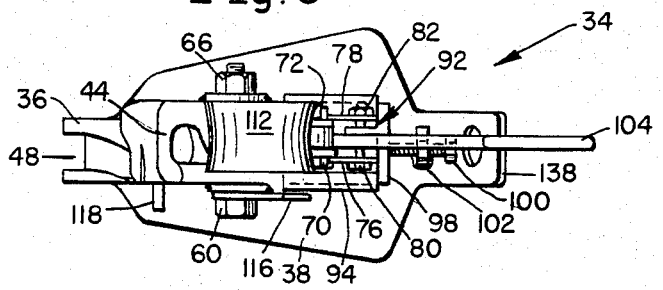
FIG. 6 is a top plan view of the wireline protector illustrated in FIG. 4.

The toggle lock mechanism 40 is formed by a pivotable elbow link 56 which is pivotally mounted in a support bracket 58 by a bolt 60 which extends through the upstanding bracket ears 62 and 64 (shown in FIG. 5). A locking nut 66 is employed in order to maintain bolt 60 as a functional pivot point. The width of the elbow link 56 at the elbow position is slightly shorter than the distance between the upstanding ears 62 and 64 of bracket 58. Clamping member 42 is pivotally affixed to one end of elbow link 56 and a handle link 68 is pivotally attached to a second end of the elbow link by a bolt 70 which is also secured by a locking nut 72 shown in FIGS. 6 and 7. The "J" shaped handle link 68 is connected by the bottom end thereof to the elbow link 56 by bolt 70 and is supported at its curved portion 74 by a pair of reaction links 76 and 78 which are connected thereto by bolt 80 which also has a locking nut 82 in order to provide a functional pivot point. The pair of reaction links 76 and 78, best seen in FIG. 6, are connected by bolt 84 to the connection member 90 mounted on slide plate 92. Bolt 84 is also provided with a locking nut 86 in order to provide a functional pivot point. The slide plate 92 is reciprocably mounted between two bracket rails 94 and 96 which are affixed to the top surface of support base 38, as shown in FIG. 2. The connection member 90 which is formed on one end of slide plate 92 is also connected to a vertical flange 98 which is, in turn, connected to the slide plate 92. An adjustment screw 100 is mounted in an upstanding ear 102 which has a threaded screw opening therein. When the adjustment screw 100 is turned clockwise, the end thereof forces flange 98 toward the clamp support 44 at the other end of the support base 38 and hence moves the position of the connection bolt 84 toward the left as seen in FIG. 4. Since the connection bolts 60, 70 and 80 interconnect the respective elbow link 56, the handle link 68 and the pair of reaction links 76 and 78, the effect of this adjustment movement is to adjust the relative positions of the two bolts 70 and 80 which change position upon operation of the handle link 68 whereby greater force can be exerted by the clamping member 42 against the wireline 8 when in clamping position as shown in FIGS. 2, 3 and 7. This adjustment movement through adjustment screw 100 is also of importance for taking up the slack which occurs during the wearing of the clamping faces 52 and 54 and other parts upon repeated use of the protector 34.

Handle link 68 is provided with a hand grip 104 and can be operated as a lever to close the toggle link clamping mechanism 40 from the open position shown in FIG. 4 to the closed position shown in FIG. 3 by exerting a downward force on the end of the hand grip 104. Such force, whether exerted by hand or by an operator's foot, will cause the hand grip portion of handle link 68 to rotate in a clockwise direction as shown in FIG. 4 and to then cause the intermediate connection bolt 80 to move downwardly beyond the center line connecting the centers of connection bolts 70 and 84. In that configuration, the portion of handle link 68 between connection bolts 70 and 80 acts as one part of a toggle link and the pair of reaction links 76 and 78 act together as the other part of the toggle link so that it is in locked position. The effect of this is to transmit the reaction force from connection bolt 84 along the line connecting the center of that bolt to the center of connection bolt 70 and then into the elbow link 56 which pivots about bolt 60 and forces clamping member 42 into engagement with wireline 8 as shown in FIG. 3. Force is transmitted from elbow link 56 to clamping member 42 by a connection pin 106 which provides pivotal attachment for this clamping member.

Figure 8:
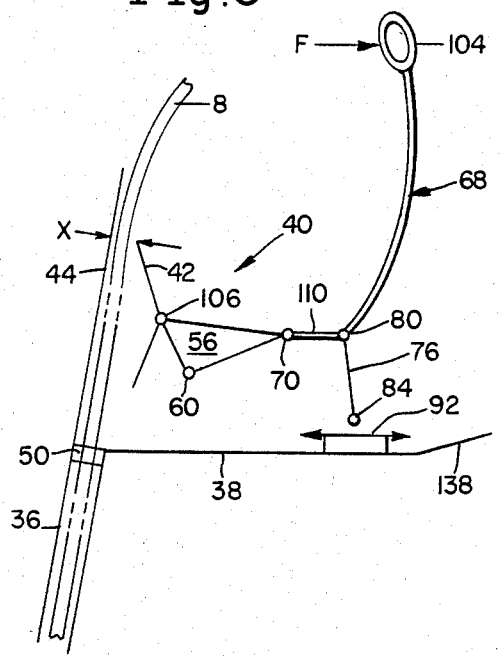
FIG. 8 is a schematic side elevational view of the wireline protector of the present invention in unclamped position.
Figure 9:
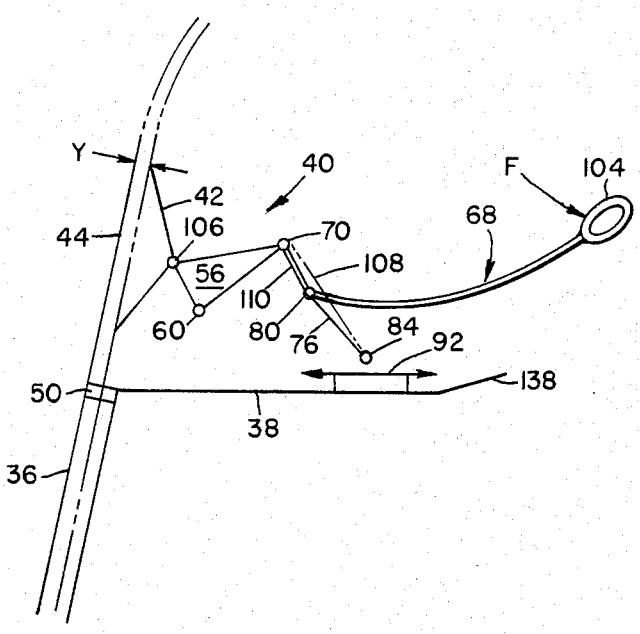
FIG. 9 is a schematic view of the wireline protector of FIG. 8 shown in the clamping position which represents its use during a drilling operation.

The operation of toggle link clamping mechanism 40 is illustrated in the schematic views shown in FIGS. 8 and 9. The handle link 68 is shown in double line for clarity. The connection bolts 60, 70, 80 and 84 have been shown as pivot pins or functional pivot points. The clamping mechanism 40 is shown in open position in FIG. 8 with a distance x between the clamping member 42 and the clamping support 44 which is an extension of the elongated section 36 is located above the top end 50 of the wireline slot 48 shown in FIGS. 2, 4, 5 and 6. The wireline 8 is interposed between these two clamping members. By a downward clockwise force exerted on hand grip 104 as shown by the arrow F, handle link 68 is pivoted about pivot pin 80 so that the pivot pin 70 moves in an upwardly direction and thus rotates elbow link 56 about the elbow position pivot point 60. This action causes the parallel positioned clamping member 42 to move closer to the wireline 8. The reaction link 76 which represents the pair of links described above supports pivot pin 80 during this movement. Continued clockwise rotation of hand grip 104 causes the pivot point 80 to move downwardly beyond center line 108 which is formed between pivot point 70 and pivot point 84. Since pivot point 80 is beyond the dead center position represented by line 108 the toggle links are locked and reaction force is transmitted from pivot point 84 along the toggle links 76 and the end portion 110 of handle link 68 to pivot point 70 when the clamping member 42 has clamped wireline 8 firmly against clamping support 44 with a distance y between the two clamp faces. A reinforcement flange 97 integrally formed from clamping support 44 extends toward bracket 58 and is welded to ear 64 as shown by weld line 99 in FIG. 5. A hole (not shown) is provided in the end of the flange for bolt 60. This flange directly reacts against the clamping force between the surfaces 52 and 54.

When the clamping surfaces 52 and 54, shown in FIG. 4 as being approximately parallel to the wireline 8, become worn adjustment of adjustment screw 100 permits pivot point 84 to be moved to the left and thus to be moved closer to the clamping support 44 which will, in turn, allow the clamping face 42 to be forced further toward this clamping support. This permits adjustment for wear on the clamping surfaces 52 and 54, and also for wear of the linkages and bolts.

Referring now to FIGS. 2–7, a wireline rest 112 is shown affixed to an extension 114 of the clamp support 44. This wireline rest 112 is in the form of a "C" and is concave about the exterior surface thereof as shown in FIGS. 5 and 6. The wireline 8 can be maintained in a taut position over this rest during use of the wireline protector 34 as shown in FIGS. 2, 3 and 7.

Also shown in FIGS. 2–5 and 7 is a hook latch 116 which is in open position as shown in FIG. 4 prior to insert of the wireline into the protector 34. Hook latch 116 is pivoted about connection bolt 60 and into engagement with latch pin 118 which is secured to the side of clamp support 44. After the wireline 8 has been placed into the groove 48 and between the clamping members 42 and 44 the hook latch 116 is closed in order to retain the wireline 8 within the clamping members prior to closing of the toggle link mechanism 40.

FIG. 7 shows the use of slips 28, 30 and 32 in greater detail over the rotary table 20 during the time that the drill string member 10 is being held by these slips. Handles 120, 122 and 124 are pivotally connected to brackets 126, 128 and 130 which are formed as an integral part of slips 28, 30 and 32, respectively. These handles allow manipulation of the slips into and away from the opening 22. The slips are configured to provide a wireline opening 132 through which the wireline protector 34 can be inserted in the manner shown in FIGS. 2 and 3, as above described. The wireline protector 34 is shown with the clamping mechanism 40 in its clamping position with hand grip 104 in its downward position and the wireline supported by the rest 112 and drawn back away from the drill string member 10. The wireline 8 is then firmly clamped between clamping members 42 and 44 and rests within the slot 48 downwardly into the opening 22. In this manner, the wireline 8 is firmly clamped in position and is protected against injury which could occur from the slips 30 and 32 closing against the unprotected wireline 8. The drill floor 24 is shown with holes 134 and 136 through which lifting devices can be inserted.

Figure 10:
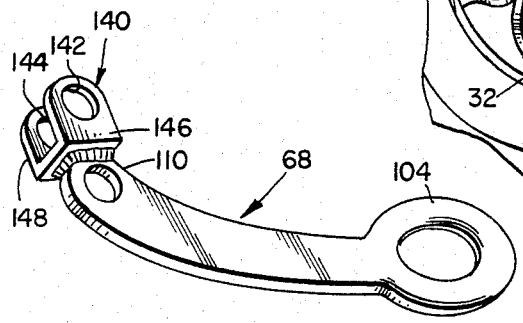
FIG. 10 is a perspective view of the handle link of the wireline protector shown in FIGS. 2–7.

The detail of the handle link 68 is seen in FIG. 10 wherein the overall "J" shape is seen extending from the hand grip 104 to the opposite end 110 which is formed by an upwardly oriented yolk 140 which has openings 142 and 144 through which bolt 70 is pivotally connected to elbow link 56. The ears 146 and 148 of yolk 140 are positioned on either side of elbow link 56 at pivot point 70.

It has been found desirable to form the clamping surfaces 52 and 54 with an internal pattern which matches the external configuration of the wireline in the case of a helically wound wireline such as shown in FIGS. 2, 3 and 7. In this manner, the effective contact between the wireline and the clamping surfaces can be increased. The clamping surfaces 52 and 54 are preferably formed arcuately to conform to the outer diameter of the wireline to be employed. These clamping surfaces thus cover approximately two-thirds of the surface area of the wireline which is clamped between members 42 and 44. The wirelines usually range in diameter from about three-sixteenths of an inch to three-fourths of an inch. The length of the clamping surfaces can range from about three inches to six inches. The longer lengths of clamping surfaces 52 and 54 are utilized for the larger diameter wirelines which are then heavier and exert more downward force against which the clamping mechanism 40 must react. For a wireline of seven-sixteenths of an inch diameter and a contact area between the two clamp surfaces of approximately two-thirds of the outer area of the wireline, a contact surface of approximately one-half square inch per inch of length of the clamping members 42 and 44 is available. Thus, for clamping members six inches in length, each of the clamping surfaces 52 and 54 will be approximately three square inches which then provides a total of six square inches of clamping surface contact to the wireline. Sufficient force can be exerted over this large clamping surface area by the toggle link clamping mechanism 40 described above to effectively prevent slippage of even quite long and thus heavy wirelines.

The wireline protector 34, described herein, has the advantage of providing a large clamping surface area for contact with the wireline, a further advantage in that the clamping forces are exerted without the use of a spring which will become weaker over its period of use, and also provides an adjustment screw 100 through which wear in the unit can be compensated for. The large clamping surface area which is provided along a substantial length of the wireline enables the effective clamping of the wireline so as to prevent slipping of the wireline into the drill hole during the steps adding additional drill string members. Additionally, the adjustment screw allows for different sizes of lines to be handled by the same wireline protector 34.

The various parts of the wireline protector described can be formed of mild steel and the construction can be welded as shown by the various weld lines in FIGS. 2–5. Particularly, the bracket rails 94 and 96 are welded to support base 38 as shown in FIGS. 2 and 5 and the bracket 58 is also welded to the support base 38 as shown in FIGS. 3 and 4. Ear 102 is welded to the upturned outer end portion 138 of the support base 38. The wireline rest 112 is also welded to extension member 114.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are, therefore, intended to be embraced therein.

What is claimed is:

1. A wireline protector for protecting an electrical wireline used in a downhole drilling operation where such wireline passes through the opening in a drilling rotary table through which the drill string passes, said wireline protector comprising:

an elongated section capable of extending through the opening in the rotary table without interfering with the drill string, said elongated section having an elongated opening into which the portion of the wireline passing through the rotary table can be inserted so as to be substantially protected by said elongated section;

a support base connected to said elongated section and capable of being arranged in engagement with the rotary table for maintaining said wireline protector in a fixed position; and clamping means mounted on said support base for enabling clamping of the wireline to prevent its movement, said clamping means including toggle links which are movable beyond the center line position.

2. A wireline protector according to claim 1, wherein said clamping means includes a wireline clamping member for operating between an open and a clamped position.

3. A wireline protector according to claim 2, wherein said wireline clamping member is maintained in an open position when said clamping means is in open position and is in a closed position with respect to said wireline when said clamping means is in a closed position.

4. A wireline protector according to claim 1, wherein said clamping means comprises a toggle lock clamping mechanism and a clamping member pivotally attached thereto for movement between open and closed clamping positions.

5. A wireline protector according to claim 4, wherein said toggle lock clamping mechanism comprises a pivotable elbow link for transmitting by a first end portion thereof a clamping force to said clamping member, a handle link pivotally connected to a second portion of said elbow link, and a reaction link means pivotally connected to said handle link by a first end thereof and having a second end thereof movably connected to said support base of said wireline protector.

6. A wireline protector according to claim 5, wherein said elbow link is pivotally connected to said support base at the elbow position and to said handle link by a first pivot pin at a first end position, and wherein said handle link is connected to said elbow link by a second pivot pin, and said reaction link means is connected to said support base of said wireline protector by a movable connection including a third pivot pin, and wherein said second pivot is movable across the center line established between said first and third pivot pins into a toggle lock position by force exerted upon said handle link.

7. A wireline protector according to claim 5, wherein said reaction link means comprises a pair of reaction links pivotally mounted on either side of said handle link.

8. A wireline protector according to claim 4, wherein said clamping member has a first clamping surface positioned parallel to said wireline and is movable into contact along a substantial length thereof upon closing of said clamping means.

9. A wireline protector according to claim 8, wherein a second wireline clamping surface is provided for cooperating with said clamping member by a portion of said elongated section.

10. A wireline protector according to claim 5, wherein a slide plate is provided as a movable connector between said second end of said reaction link and said support base of said wireline protector, and wherein an adjustment means is provided for moving said slide plate relative to said support base.

11. A wireline protector according to claim 10, wherein said adjustment means is an adjustment screw mounted in an ear attached to said support base of said wireline protector, and said adjustment screw abuts said slide plate, whereby said slide plate is movable relative to said support base upon rotation of said adjustment screw.

12. A wireline protector according to claim 10, wherein said slide plate is movably secured to said support base by a pair of bracket rails mounted on said base.

13. A wireline protector according to claim 5, wherein said elbow link is pivotally mounted at the elbow position thereof upon said support base.

14. A wireline protector according to claim 1, wherein a hook latch is mounted on said wireline protector for latching a wireline into said clamping means when in an opened position.

15. A wireline protector according to claim 1, wherein the circumference of said elongated section is non-circular so as to avoid any tendency for said wireline protector to roll within the opening in the rotary table.

16. A wireline protector according to claim 1, wherein said support base and said elongated section are respectively oriented so as to encompass an angle of approximately 100°.

17. A wireline protector according to claim 1, wherein the access of said elongated opening extends along a path that turns between the two longitudinal ends of said elongated section.

18. A wireline protector according to claim 17, wherein said path turns by approximately 90°.

19. A wireline protector for protecting an electrical wireline used in a downhole drilling operation where such wireline passes through the opening in a drilling rotary table through which the drill string passes, said wireline protector comprising:

an elongated section capable of extending through the opening in the rotary table without interfering with the drill string, said elongated section having an elongated opening into which the portion of the wireline passing through the rotary table can be inserted so as to be substantially surrounded by said elongated section for protecting the wireline, the access of said elongated opening extends along a path that turns between the two longitudinal ends of said elongated section;

a support base extending approximately perpendicularly to said elongated section and capable of being arranged on the rotary table for maintaining said wireline protector in place; and clamping means mounted on said support base for enabling clamping of the wireline within said elongated section to prevent movement thereof, said clamping means including toggle links which are movable beyond the center line position.

20. A wireline protector according to claim 19, wherein said clamping means comprises a toggle lock clamping mechanism and a clamping member pivotally attached thereto for movement between open and closed clamping positions.

21. A wireline protector according to claim 20, wherein said toggle lock clamping mechanism comprises a pivotable elbow link for transmitting by a first end portion thereof a clamping force to said clamping member, a handle link pivotally connected to a second portion of said elbow link, and a reaction link means pivotally connected to said handle link by a first end thereof and having a second end thereof movably connected to said support base of said wireline protector.

22. A wireline protector according to claim 19, wherein the circumference of said elongated section is non-circular so as to avoid any tendency for said wireline protector to roll within the opening in the rotary table.

23. A wireline protector according to claim 22, wherein the cross-sectional shape of said elongated opening is a parallelogram.

24. A method for adding drill string members in a downhole drilling assembly, such assembly including:

a downhole drilling motor, an electrical sensing member, a drill string having at least one drill string member, a kelly attached to the upper end of the drill string, a rotary table having an opening through which the kelly and the drill string extends, and a supply of electrical wireline, which wireline extends through the opening in the rotary table;

the method comprising the steps of: raising the kelly and the drill string when another drill string member is to be attached, with the drill string being raised sufficiently so that the top portion of the uppermost drill string member extends through the opening in the rotary table;

inserting slip members between the uppermost drill string member and the rotary table for securing the drill string to the rotary table;

inserting a wireline protector through the opening in the rotary table, such wireline protector having an elongated opening;

placing the portion of the electrical wireline extending through the opening in the rotary table into the elongated opening in the wireline protector for protecting the electrical wire from the slip members and the drill string; and clamping the electrical wireline within the wireline protector by application of force applied over a substantial length of the wireline.

25. The method according to claim 24, wherein the length of wireline clamped is from about three to six inches.

26. A method according to claim 24 further comprising the step of retaining the electrical wire in the wireline protector while a drill string member is being attached.

27. A method according to claim 26 further comprising the steps of unclamping the electrical wireline from the wireline protector and removing the wireline protector after the additional drill string member has been attached.

* * * * *